US005399093A

United States Patent [19]

Schneider et al.

[11] Patent Number: 5,399,093

[45] Date of Patent: Mar. 21, 1995

[54] LOW PROFILE ROTATABLE ELECTRICAL PLUG

[75] Inventors: Roy J. Schneider, Indianapolis; Craig Stewart, Noblesville, both of Ind.

[73] Assignee: Woods Industries, Inc., Carmel, Ind.

[21] Appl. No.: 189,903

[22] Filed: Feb. 1, 1994

[51] Int. Cl.[6] ..... H01R 35/00

[52] U.S. Cl. ..... 439/21

[58] Field of Search ..... 439/21, 22, 20

[56] References Cited

U.S. PATENT DOCUMENTS

| | | | |
|---|---|---|---|
| 1,238,448 | 8/1917 | Shaw | 439/21 |
| 1,714,763 | 5/1929 | Boyson . | |
| 1,950,036 | 3/1934 | Preston . | |
| 1,975,964 | 10/1934 | Mayhew | 439/20 |
| 1,984,181 | 12/1934 | French . | |
| 2,226,209 | 12/1940 | Rizzuto . | |
| 2,425,679 | 8/1947 | Jackson . | |
| 2,433,938 | 1/1948 | Varner . | |
| 2,542,609 | 2/1951 | Wyglendowski . | |
| 2,869,102 | 1/1959 | Hubbel, Jr. . | |
| 2,892,172 | 6/1959 | McGann, Jr. . | |
| 2,898,572 | 8/1959 | Shinn | 439/22 |
| 3,032,740 | 5/1962 | Hoorn . | |
| 3,137,536 | 6/1964 | Healy . | |
| 3,335,395 | 8/1967 | Smith . | |
| 3,474,376 | 10/1969 | Preiss . | |
| 3,479,632 | 11/1969 | Galles . | |
| 3,718,890 | 2/1973 | Sheldon . | |
| 3,747,049 | 7/1973 | Cressman et al. . | |
| 3,950,069 | 4/1976 | Wiley . | |
| 3,975,075 | 8/1976 | Mason . | |
| 4,026,618 | 5/1977 | Straka . | |
| 4,771,367 | 9/1988 | Serr et al. | 439/622 |
| 4,927,376 | 5/1990 | Dickie | 439/694 |
| 5,114,352 | 5/1992 | Gahagen et al. | 439/22 |

*Primary Examiner*—Gary F. Paumen

*Attorney, Agent, or Firm*—McAndrews, Held & Malloy, Ltd.

[57] ABSTRACT

A low profile rotatable electrical plug includes a housing and a set of conductive prongs positioned on one face of the housing for insertion into a conventional wall outlet. A power cord exits the housing in a direction generally perpendicular to the prongs such that the cord parallels the wall when the plug is inserted into a wall outlet. A rotative coupling device mounted within the housing provides a rotative electrical connection between the power cord and the prongs. The rotative coupling device includes first and second sets of conductors carried by respective conductor support plates. The conductors in the first support plate are electrically connected to respective conductors in the power cord, and the conductors in the second support plate are electrically connected to respective prongs. The first support plate is fixedly mounted within the housing and the second support rotates within the housing relative to the first support plate. The prongs extend from the second support plate and through an aperture in the housing for rotation relative to the cord. The plug further includes structure for releasably locking the position of the power cord with respect to the prongs.

25 Claims, 5 Drawing Sheets

LOW PROFILE ROTATABLE ELECTRICAL PLUG

FIELD OF THE INVENTION

The present invention relates generally to an electrical plug and, more particularly, to an electrical plug having a low profile housing and a rotatable electrical cord.

BACKGROUND OF THE INVENTION

Conventional electrical plugs are undesirable because they typically include a housing which protrudes a substantial distance from the wall once the plug is inserted into the outlet. This protrusion makes the plug susceptible to unintentional disengagement by moving objects and also prevents furniture and other objects from being placed close to the wall.

Over the years a variety of plugs have been developed which have low profile housings (hereinafter referred to as "low profile plugs"). Low profile plugs are advantageous because they have a reduced housing profile in comparison to conventional electrical plugs. As such, they are less susceptible to unintentional disengagement and permit objects to be placed closer to the wall than is possible with conventional plugs.

In most low profile plugs, the power cord exits the plug perpendicular to the prongs so as to decrease the profile of plug's housing. Hence, when the plug is inserted into a wall outlet, the power cord exits the plug housing parallel to the face of the wall outlet. These plugs are undesirable because it is possible for the cord to block other receptacles in the outlet, thereby preventing additional plugs from being inserted into the outlet. This is even more of a problem with polarized plugs or plugs incorporating a ground prong since these plugs can only be inserted into the wall outlet in one orientation.

In recognition of this problem, it is known to orient the electrical cord to ensure that it does not overlay the other receptacles in the outlet. Examples of such designs are illustrated in U.S. Pat. No. 4,927,376 issued to Dickie and U.S. Pat. No. 3,975,075 issued to Mason. Dickie discloses a low profile plug in which the cord exits the plug body at an acute angle with respect to a vertical axis of the plug. The cord then passes through a sleeve that reorients the cord with the vertical axis. Similarly, Mason discloses a profile plug in which the cord exits tangentially from a circular plug housing at such an angle that it does not overlay the other receptacles in a standard wall outlet. When several plugs are inserted into a single wall outlet, such plug designs are undesirable because all of the cords leave the outlet in the same direction. As such it is difficult to route electrical cords in several directions from a single wall outlet without entangling the various cords. Besides being unsightly, tangled electrical cords should be avoided because they can be dangerous.

This problem can be addressed by a plug design in which the cord rotates with respect to the prongs. An example of a rotatable plug is illustrated in U.S. Pat. No. 4,026,618 to Straka. However, the rotatable plug described in Straka is undesirable for several reasons. First, it is now common for electrical plugs to include three prongs. However, Straka only discloses a two-prong rotatable plug and does not provide a method for incorporating three prongs in a rotatable plug. Second, in Straka a bolt extends through the plug components to hold the components together and to serve as an axis of rotation for the plug's components. This bolt is problematic because it extends beyond the back face of the plug and hence can prevent the plug from being fully inserted into an outlet. In addition, the bolt can be loosened by rotation of the plug components. Finally, in many applications it is desirable to fix the cord's position once the plug is inserted in an outlet; however, Straka does not provide a method for quickly locking the position of the cord with respect to the prongs.

The present invention is directed to overcoming one or more of the above-noted problems.

More specifically, it is an object of the present invention to provide a low profile plug that is economical and simple to manufacture.

It is another object of the present invention to provide a low profile electrical plug in which the cord rotates 360° with respect to the prongs.

Still another object of the present invention is to provide a rotatable low profile electrical plug in which the position of the cord is releasably lockable with respect to the position of the prongs.

It is another object of the present invention to provide a low profile electrical plug which can incorporate two electrical prongs or three electrical prongs without substantial design changes or manufacturing set up changes.

Other objects and advantages of the invention will become apparent upon reading the following detailed description and appended claims, and upon reference to the accompanying drawings.

SUMMARY OF THE INVENTION

In accordance with one aspect of the present invention a low profile rotatable electrical plug comprises first and second sets of electrical conductors. At least one of the sets of electrical conductors consists of a set of concentric annular conductors. A first support plate has a face configured to carry the first set of electrical conductors an second support plate has a first face configured to carry the second set of electrical conductors. A means rotatably connects the first and second support plates such that each conductor in the first set rotatably and electrically contacts a different one of the conductors in the second set. A power cord is attached to the first support plate for rotation therewith and has electrical conductors connected to a different ones of the electrical conductors in the first set of electrical conductors. Conductive prongs are electrically connected to different ones of the electrical conductors in the second set and extend from a second face of the second support plate for rotation with the second support plate. A means is provided for releasably locking the position of the first support plate with respect to the second support plate.

In accordance with another aspect of the present invention a low profile rotatable electrical plug comprises a housing having an interior compartment, a flat face with an aperture formed therein, and a side wall extending from the flat face. The plug also includes first and second sets of electrical conductors, wherein at least one of set of conductors comprises a set of concentric annular conductors. A first support plate is fixedly mounted within the housing interior compartment and has a face configured to carry the first set of electrical conductors. A second support plate is mounted within the housing interior compartment for rotation relative to the first support plate. The second support plate has a first face rotatably engaging the face of the first support plate and being configured to carry the second set of conductors such that each conductor in the second set rotatably and electrically contacts a different one of the conductors in the first set. A power cord has electrical conductors connected to different ones of the electrical conductors in the first set. The power cord is affixed to the first plate and extends through the housing side wall for electrical connection to a remote device. Electrical prongs extend from the second face of the second support plate and through the aperture in the housing face for rotation with the second support plate. Each electrically conductive prong is connected to a different one of the electrical conductors in the second set of electrical conductors.

BRIEF DESCRIPTION OF THE DRAWINGS

For a more complete understanding of this invention reference should now be had to the embodiment illustrated in greater detail in the accompanying drawings and described below by way of example of the invention.

In the drawings.

DETAILED DESCRIPTION OF THE PREFERRED EMBODIMENTS

In the following detailed description, spatially orienting terms are used such as "left," "right," "upward," "downward," and the like. It is to be understood that these terms are used for convenience of description of the preferred embodiments by reference to the drawings. These terms do not necessarily describe the absolute location in space, such as left, right, upward, downward, etc., that any part must assume.

Figure 1:
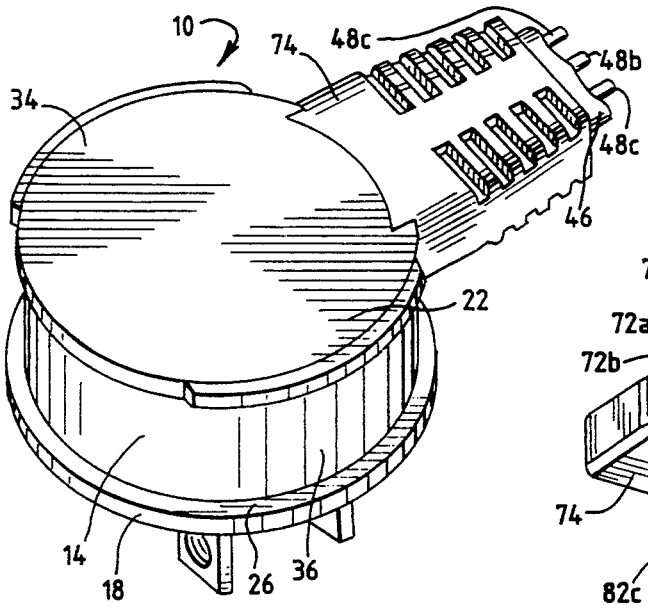
FIG. 1 is a top perspective view of a three-prong low profile rotatable electric plug in accordance with the present invention.
Figure 2:
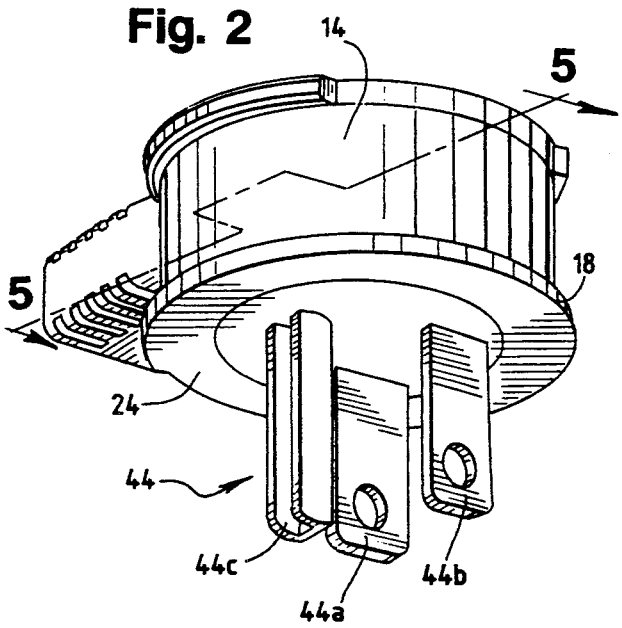
FIG. 2 is a bottom perspective view of the electrical plug of FIG. 1.
Figure 3:
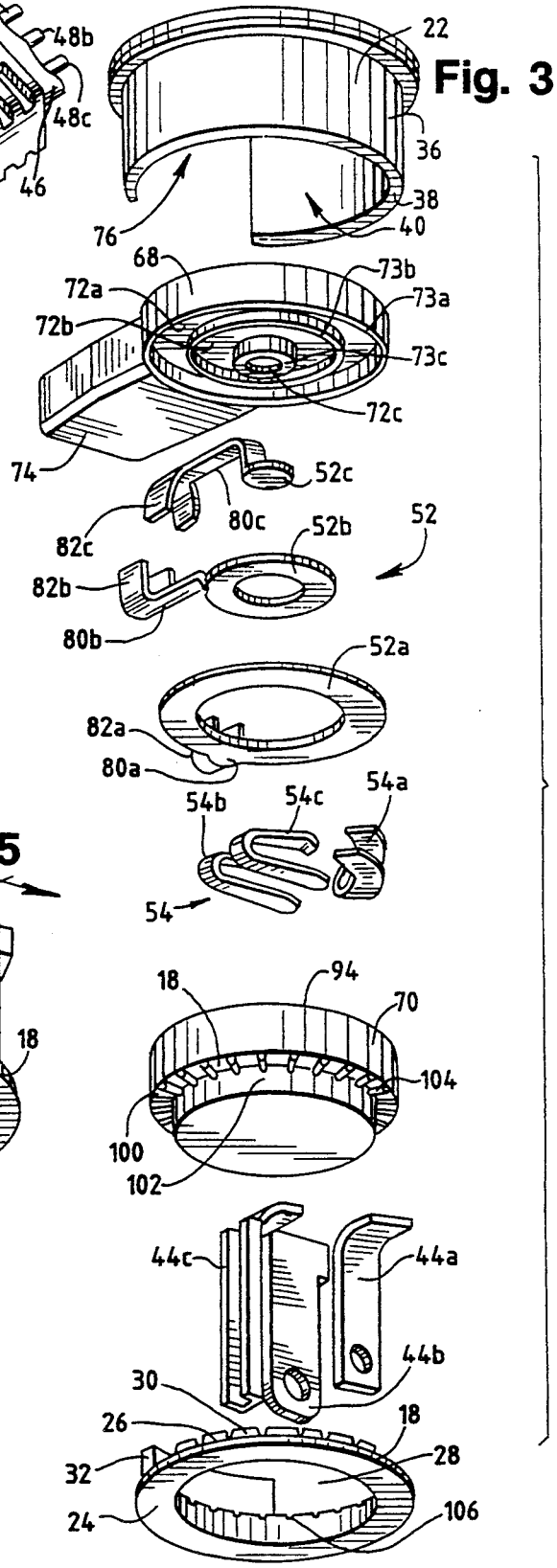
FIG. 3 is an exploded perspective view of the electrical plug of FIG. 1.

Referring initially to FIGS. 1–6, a three-prong embodiment of a low profile rotatable electrical plug 10 includes a housing 14 formed of nonconductive material such as plastic and having two integrally connected housing portions 18, 22. As shown in FIG. 3, housing portion 18 forms the bottom of housing 14 and is in the shape of a flat annular ring. Bottom portion 18 has a bottom or exterior face 24 (FIG. 2), an inside face 26 (FIG. 5), and a center circular aperture 28 (FIG. 3) extending between the inside and exterior faces.

Figure 5:
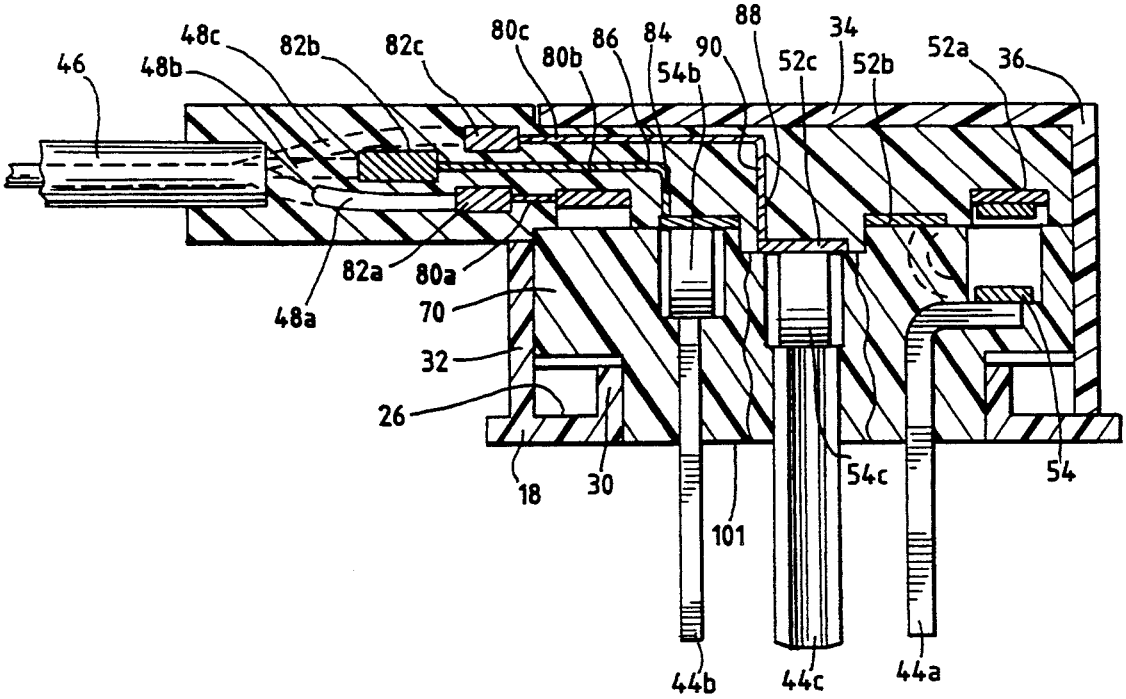
FIG. 5 is a sectional side view of the electric plug of FIG. 1.

A raised circular collet 30 is formed on the inside face 26 and circumscribes center aperture 28, as seen in FIGS. 3 and 5. Collect 30 serves as an annular wall member which extends upwardly and perpendicularly from face 26. In addition, an upwardly extending side wall 32 is molded to stand perpendicularly from inside surface 26.

Housing portion 22 forms the top portion of housing 14 and is formed of a circular top 34 and a cylindrically shaped side wall 36 extending downwardly from circular top 34. Side wall 36 is of a diameter greater than the diameter of raised collet 30. Side wall 36 terminates in a bottom surface 38 (FIG. 3) which seats against inside face 26 of bottom portion 18 and seats to the outside of raised collet 30.

Housing portions 18, 22 are formed from injection molded ABS plastic and may be connected together to form the integral housing 14. Preferably, housing portions 18, 22 are connected by ultrasonic welding of the bottom surface 38 of side wall 36 to inside face 26 of housing portion 18. Once joined, housing portions 18, 22 form a cylindrical interior compartment 40 defined more particularly by circular top 34, side wall 36, side wall 32 and bottom portion 18.

Referring to FIG. 2, a plurality of electrically conductive outlet prongs 44 extend through the center aperture 28 in a direction perpendicular to the exterior face 24 of bottom portion 18. Conductive prongs 44 include a live or power prong **44*a*, a common prong 44*b* and a ground prong 44*c*. Prongs 44** are oriented for insertion into a conventional polarized electrical receptacle.

Figure 4:
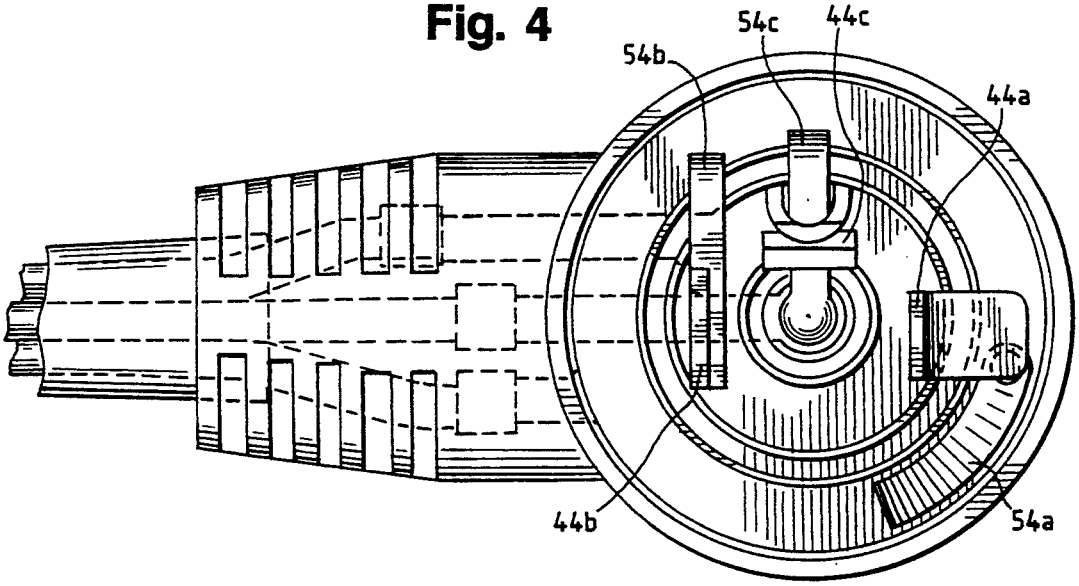
FIG. 4 is a bottom sectional bottom view of the electrical plug of FIG. 1.

As shown in FIG. 5, a power cord 46 provides power through the housing side walls to prongs 44. The remote end of the power cord may be connected to a remote device such as a lamp or an appliance (not shown). As shown in FIGS. 4 and 5, power cord 46 includes a power conductor **48*a*, a common conductor 48*b*, and a ground conductor 48*c*. Each conductor 48 is electrically connected to a respective prong 44 via a rotative coupling structure which is explained in greater detail below. The rotative coupling structure permits power cord 46 to rotate 360° with respect to prongs 44** while maintaining power to the prongs.

Power cord 46 exits plug 10 in a direction perpendicular to the extended direction of prongs 44. Hence, when plug 10 is inserted into a wall outlet, power cord 46 exits housing 14 parallel to the face of the wall outlet. This orientation of power cord 46 decreases the thickness of the housing 14 and permits furniture and other objects to be placed close to the wall. Thus, the profile of plug 10 may be kept low.

As best seen in FIG. 3, the rotative coupling structure includes two sets of electrical conductors 52, 54. The set of conductors 52 is in the form of a plurality of concentric annular conductors or conductive rings **52*a*, 52*b*, 52*c*. The set of conductors 54 is in the form of a plurality of electrically conductive spring contacts 54*a*, 54*b*, 54*c***.

In a three-prong plug, annular conductors 52 include an outer annular conductor **52*a* which functions as a power conductor, a middle annular conductor 52*b* which functions as a common conductor, and an inner annular (or circle) conductor 52*c* which functions as a ground conductor. Similarly, the set of conductive spring contacts includes an arcuate spring contact 54*a* which functions as a power conductor, a linear spring contact 54*b* which functions as common conductor, and a linear spring contact 54c** which functions as a ground conductor.

The two sets of electrical conductors 52, 54 are carried by a pair of non-conductive support plates 68, 70, respectively. Numerous materials are suitable for forming support plates 68, 70; however, support plates 68, 70 are preferably formed from injection molded polyvinyl chloride (PVC). Support plates 68, 70 are generally cylindrical in shape and are mounted within the housing interior compartment 40 such that the prongs they carry rotatably engage each other. The two sets of conductors are positioned on faces formed in the support plates such that each annular conductor 52 rotatably engages and electrically contacts a respective one of the conductive spring contacts 54.

For this purpose, a plurality of concentric annular grooves 72a, 72b, 72c are formed in the lower face of support plate 68. Annular grooves 72 are configured to support different ones of the annular conductors 52 and to electrically isolate the annular conductors 52 one from the other. More specifically, support plate 68 includes an outer annular groove 72a, a middle annular groove 72b, and an inner annular or circle-shaped groove 72c. Annular grooves 72 are separated by cylindrical side walls 73a, 73b, 73c which both ensure electrical isolation between the annular conductors and function as bearing surfaces for the prongs carried by support plate 70. As best seen in FIG. 5, annular grooves 72 are formed in different parallel planes so that each annular conductor 52 is supported in a different plane than the other annular conductors.

Annular conductors 52 are in turn electrically connected to respective ones of the power cord conductors 48. Preferably this connection is made via connection arms 80a, 80b, 80c which extend from annular conductors 52. Each connection arm 80 terminates in a wire crimp 82a, 82b, 82c which attaches the respective connection arm to a respective power cord conductor 48. Connection arms 80 are shaped to maintain electrical isolation between annular conductors 52 and to provide for 360° of electrical contact between each of the annular conductors 52 and its associated conductive spring 54.

More specifically, the outer annular conductor 52a has a connection arm 80a which extends radially from and in the same plane as the outer annular conductor 52a. The middle annular conductor 52b has a connection arm 80b which includes a first portion 84 extending upwardly from annular conductor 52b and a second portion 86 extending perpendicularly from the top of the first portion 84 in a plane above and generally parallel to the plane of the outer annular conductor 52a. Similarly, the inner annular conductor 52c has a connection arm 80c that includes a first portion 88 extending upwardly from the inner annular conductor 52c and a second portion 90 which extends perpendicular from the top of the first portion 88 in a plane above and generally parallel to plane of the second portion 86 of the middle connection arm 80b.

During assembly, power cord conductors 48 are connected to the annular conductors 52 via wire crimps 82a–c. Support plate 68 is then injection molded around the integral assembly of the power cord 46 and the annular conductors 52a–c. The injection molding process fixes the orientation of annular conductors 52 in annular grooves 72a–c and electrically isolates annular conductors 52 from each other.

Referring again to FIG. 1, a strain relief member 74 is formed at the junction of power cord and support plate 68 so as to fixedly attach the power cord 46 to support plate 68. An aperture or slot 76 (FIG. 3) formed in side wall 36 of housing portion 22 is adapted to receive strain relief member 74 when support plate 68 is positioned into housing interior compartment 40.

Upward extending side wall 32 formed on the bottom portion 18 extends into the side wall aperture 76 and fills the gap in cylindrical wall 36 below strain relief member 74. The combination of strain relief member 74 and side wall aperture 76 locates the position of support plate 68 relative to housing 14.

Figure 6:
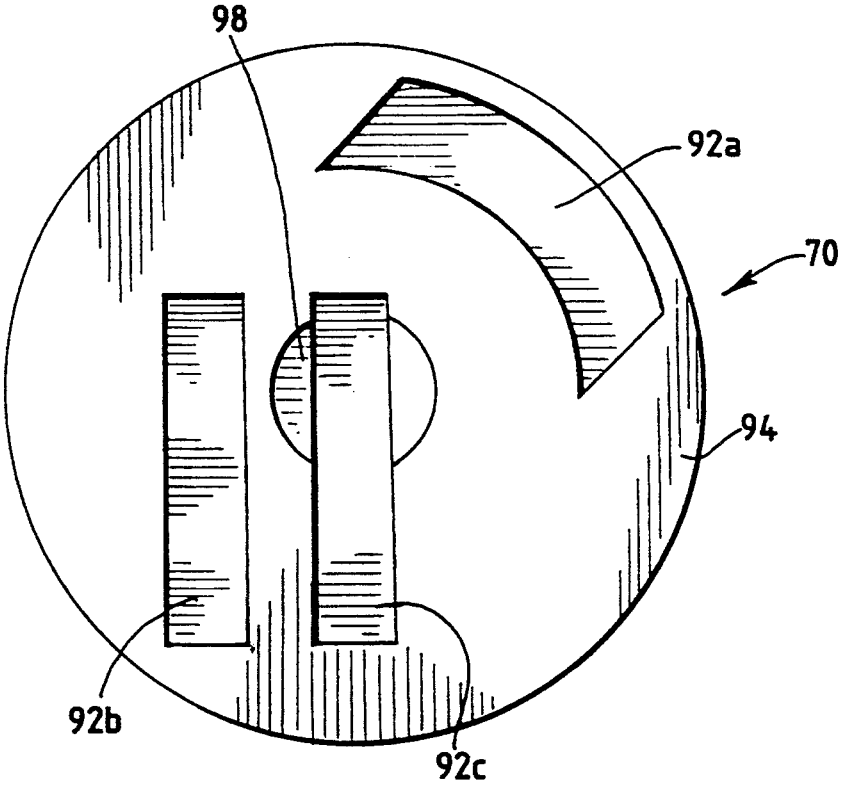
FIG. 6 is a top view of a support plate from the electrical plug of FIG. 1.
Figure 7:
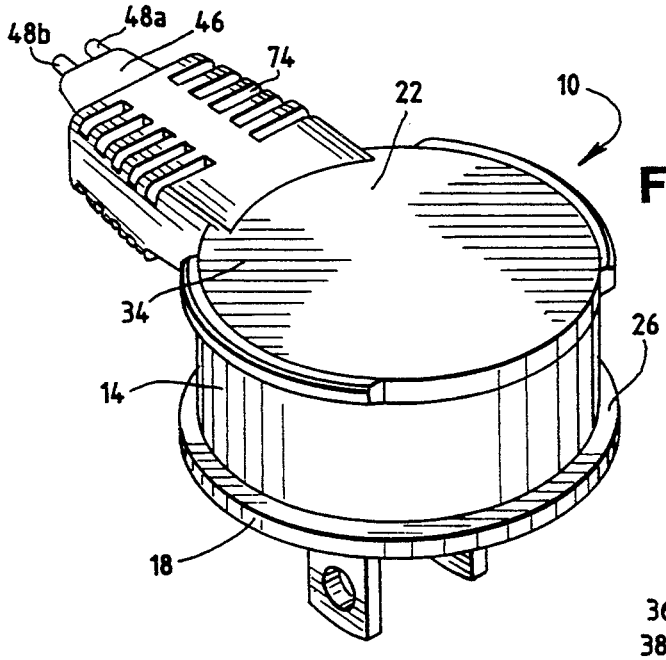
FIG. 7 is a top perspective view of a two-prong low profile rotatable electric plug in accordance with the present invention.
Figure 8:
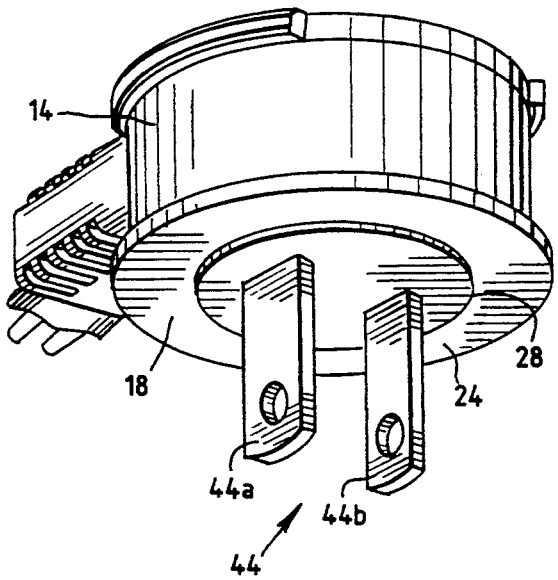
FIG. 8 is a bottom perspective view of the electrical plug of FIG. 7.
Figure 9:
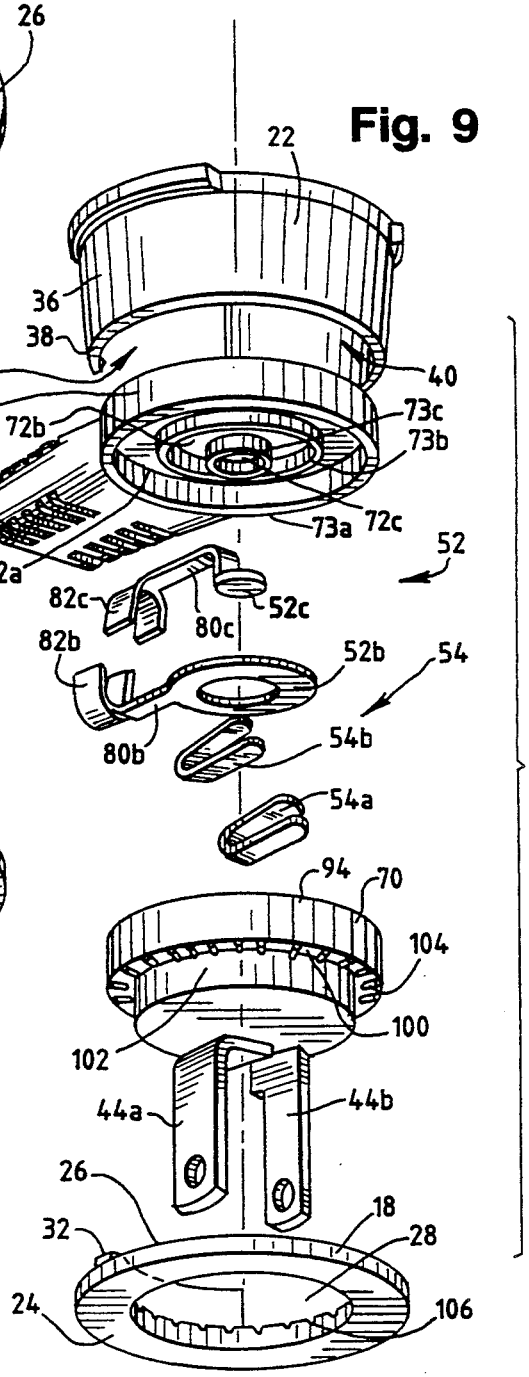
FIG. 9 is an exploded perspective view of the electrical plug of FIG. 7.
Figure 10:
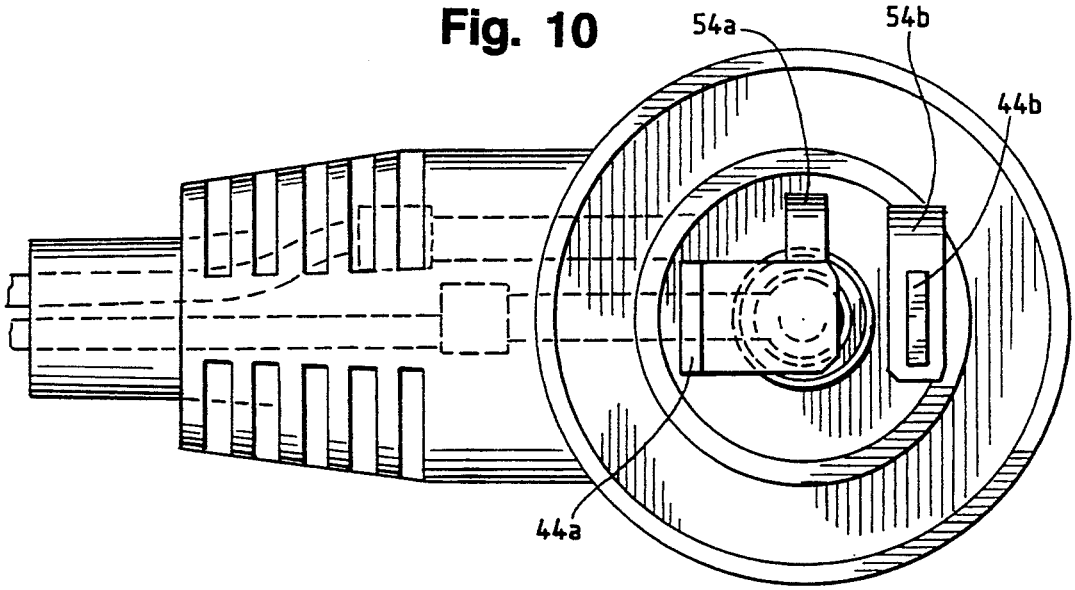
FIG. 10 is a sectional bottom view of the electrical plug of FIG. 7.
Figure 11:
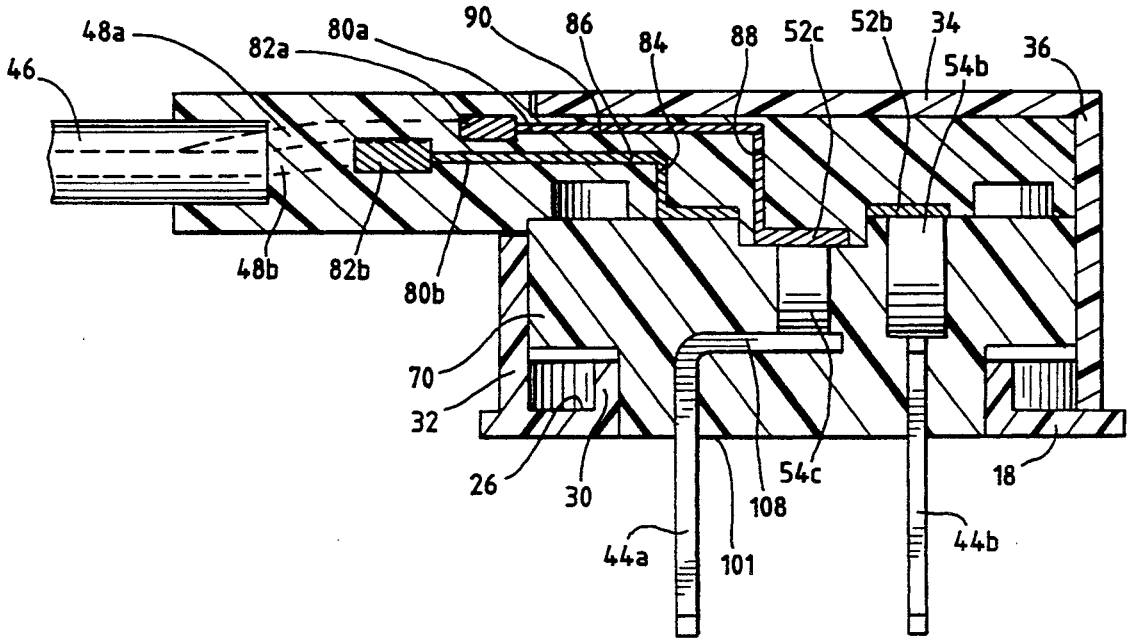
FIG. 11 is a sectional side view of the electric plug of FIG. 7.

As best seen in FIGS. 5 and 6, conductive spring contacts 54 are carried in slots 92 formed in the top face 94 of support plate 70. Slots 92 are formed during the injection molding process and each slot 92 is configured to accommodate a different one of the conductive spring contacts 54. More specifically, top face 94 carries an arcuate slot 92a (FIG. 6) and a pair of linear slots 92b, 92c which are adapted to carry arcuate spring contacts 54a and linear spring contacts 54b, 54c, respectively.

When support plates 68, 70, are mounted in housing interior compartment 40, linear slot 92b aligns with middle annular groove 72b, linear slot 92c aligns with inner annular groove 72c, and arcuate slot 92a aligns with outer annular groove 73a. Conductive spring contacts 54 are slid into slots 92 during assembly and are sized to extend beyond top face 94 of support plate 70 when positioned in slots 92. Since spring contacts 54 extend beyond top face 94 of support plate 70, spring contacts 54 are compressed against annular conductors 52 positioned in the face of support plate 68.

A circular recess 98 (FIG. 6) formed in the center of support plate 70 receives and supports side wall 73c from inner annular grove 72c. Compression of the springs 54 in this manner ensures a good electrical contact between the annular conductors and the conductive spring contacts.

The bottom of support plate 70 includes a reduced diameter portion 102 which extends through and rotatably engages center aperture 28 of housing portion 18. Conductive prongs 44 extend from the reduced diameter portion 102 in a direction perpendicular to the bottom face 101 of the portion 102. Hence, when support plate 70 is positioned in housing 14, prongs 44 extend through center aperture 28 for rotation with support plate 70.

Prongs 44 are injection molded into support plate 70 and are oriented for insertion into a conventional electrical outlet. The proximate ends of prongs 44 are embedded in support plate 70 when the support plate is injection molded. Prongs 44 are positioned in support plate 70 such that a portion of each prong 44a–c is disposed in the bottom of the spring receiving slots 92a–c so as to make electrical contact with a respective one of the conductive spring contacts 62a–c. Conductive spring contacts 62a–c in turn contact respective annular conductors 58a–c and the annular conductors are electrically connected to respective power cord conductors 48a–c.

In this manner, a 360° rotatable electrical connection is provided between each prong 44a–c and a respective one of the power cord conductors 48a–c. As support plate 70 is rotated relative to support plate 68, spring contacts 54 move along annular rings 52 maintaining the electrical connection.

The position of power cord 46 with respect to prongs 44 is releasably lockable. A plurality of radial ribs 104 are formed in a bottom face 100 of support plate 70. Ribs 104 are axially spaced at regular intervals about reduced diameter portion 102 and are adapted to releasably engage reciprocal notches 106 formed in raised collet 30. Ribs 104 and reciprocal notches 106 releasably lock the position of support plate 68 with respect to support plate 70 and, hence, lock the position of power cord 46 with respect to prongs 44.

As will be understood, the particular locking structure may take on numerous other forms without departing from the scope of the present invention. For example, the locking structure may include a plurality of ribs and reciprocal notches formed in the conductor carrying faces of the conductor support plates 68, 70.

FIGS. 7–11 illustrate a two-prong embodiment of electric plug 10. The design of the two-prong plug is very similar to the design of the three-prong plug. Hence, the same reference numbers which were used in FIGS. 1–6 are used to identify like components in FIGS. 7–11 and only a brief description of the differences between the two plugs is provided. The main difference is that arcuate spring 62*a*, arcuate slot 92*a*, and outer annular conductor 58*a* are not used in the two-prong plug. In addition, power prong 44*a* is positioned in second support plate 70 such that its lateral flange 108 extends into the bottom of the second linear slot 92*c*, rather than extending into the bottom or the arcuate slot 92*a*. Because the position of power prong 44*a* is different, lateral flange 108 of power prong 44*a* must be longer in the two-prong plug than it is in the three-prong plug to ensure proper spacing between power prong 44*a* and common prong 44*b*.

As can be appreciated from the above description, the design of the present low profile plug makes it possible to produce both two-prong and three-prong plugs without any substantial design changes. As a result, it is more economical to produce both two-prong and three-prong versions of the electrical plug.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. A low profile rotatable electrical plug comprising:

a housing having (i) an interior compartment, (ii) a bottom flat face with a prong receiving aperture formed therethrough, and (iii) a side wall extending upwardly from said flat face;

a first set of N electrical conductors;

a second set of N electrical conductors, at least one of said first and second sets of electrical conductors comprising a set of annular conductors;

a first support plate mounted within said housing interior compartment and configured to carry said first set of electrical conductors;

a second support plate mounted within said housing interior compartment for rotation relative to said first support plate, said second support plate carrying said second set of electrical conductors in a location for electrically mating of each of said second conductors with a conductor in said first set of conductors;

a power cord having N electrical cord conductors, each said electrical cord conductors being electrically connected to a different one of the electrical conductors in said first set, a cord relief molded integrally with said first support plate and molded about one end of said power cord to form an insert assembly, said cord relief extending through said housing side wall;

N electrical prongs extending from said second support plate and through the aperture in the housing face, each electrically conductive prong being electrically connected to a different one of the electrical conductors in said second set.

2. A low profile electrical plug as set forth in claim 1, further comprising locking means for releasably locking the position of said power cord relative to said prongs.

3. A low profile rotatable electrical plug as set forth in claim 2, wherein said locking means releasably locks the position of said second support plate with respect to said housing.

4. A low profile rotatable electrical plug as set forth in claim 2, wherein said locking means comprises a plurality of ribs and reciprocal notches.

5. A low profile rotatable electrical plug as set forth in claim 2, wherein said locking means comprises a plurality of radial ribs axially spaced about the second face of said second support at regular intervals and a plurality of reciprocal notches formed in the interior of said housing, said ribs being positioned to engage said notches and releasably lock the position of said second support relative to said housing.

6. A low profile rotatable electrical plug as set forth in claim 1, wherein said housing comprises first and second integrally connected housing portions.

7. A low profile rotatable electrical plug as set forth in claim 6, wherein said first and second housing portions are sonic welded together to form said housing.

8. A low profile rotatable electrical plug as set forth in claim 1, wherein N equals two.

9. A low profile rotatable electrical plug as set forth in claim 1, wherein N equals three.

10. A low profile rotatable plug as set forth in claim 1, wherein said first set of electrical conductors comprises N concentric annular conductors and said second set of electrical conductors comprises N elongated conductive springs.

11. A low profile rotatable electrical plugs set forth in claim 1, wherein the face of said first support plate includes N concentric annular grooves formed in different planes, each groove being configured to carry a different one of said concentric annular conductors.

12. A low profile rotatable electrical plug comprising:

a first set of N electrical conductors;

a second set of N electrical conductors, at least one of said first and second sets of electrical conductors comprising a set of concentric annular conductors;

a first support plate having a face configured to carry said first set of electrical conductors;

a second support plate having first and second opposing faces, said first face being configured to carry said second set of electrical conductors;

means for rotatably connecting said first and second support plates such that each conductor in said first set rotatably and electrically contacts a different one of the conductors is said second set;

a power cord having N electrical conductors, each electrical cord conductor being electrically connected to a different one of the conductors in said first set, said power cord being affixed with respect to said first support plate;

N conductive prongs extending from and fixed with respect to the second face of said second support plate for rotation with the second support plate, each conductive prong being electrically connected to a different one of the conductors in said second set; and locking means for releasably locking the position of said first support plate with respect to said second support plate.

13. A low profile rotatable electrical plug as set forth in claim 12, wherein said locking means comprises a plurality of ribs and reciprocal notches formed in the conductor carrying faces of said first and second support plates.

14. A low profile rotatable electrical plug as set forth in claim 12, wherein said locking means comprises a plurality of radial ribs axially spaced about the second face of said second support plate at regular intervals and a plurality of reciprocal notches formed in the interior of said housing, said ribs being positioned to engage said notches and to releasably lock the position of said second support plate relative to said housing.

15. A low profile rotatable electrical plug as set forth in claim 12, wherein said means for rotatably connecting said first and second conductor support plates comprises a housing formed around said first and second conductor support plates.

16. A low profile rotatable electrical plug as set forth in claim 15, wherein said housing comprises first and second integrally connected housing portions.

17. A low profile rotatable electrical plug as set forth in claim 16, wherein said first and second housing portions are sonic welded together to form said housing.

18. A low profile rotatable electrical plug as set forth in claim 12, wherein N equals two.

19. A low profile rotatable electrical plug as set forth in claim 12, wherein N equals three.

20. A low profile rotatable plug as set forth in claim 12, wherein said first set of electrical conductors comprises N concentric annular conductors and said second set of electrical conductors comprises N elongated conductive springs.

21. A low profile rotatable electrical plugs set forth in claim 20, wherein the face of said first support plate includes a N concentric annular grooves formed in different planes, each groove being configured to carry a different one of said concentric annular conductors.

22. A low profile electrical plug, comprising:

a first housing portion having a front face, a back face, and a center aperture extending between said front and back faces;

a second housing portion having a circular top and an annular sidewall wall extending from said circular top, said annular side wall including a bottom surface adapted to engage the back face of said first housing portion;

means for connecting said first and second housing portions to form an integral housing having an interior compartment defined by said circular top, said annular side wall and the back face of said second housing portion;

a plurality of concentric annular conductors;

a plurality of elongated conductive springs;

a first support plate fixedly mounted in said housing interior compartment, said first support plate having a face with a plurality of concentric annular grooves formed in different planes thereof, each annular groove being adapted to support a different one of said annular conductors;

a second support plate mounted within said housing compartment for rotation relative to said first support plate, said second support plate having first and second opposing faces, said first face being configured to carry said conductive spring conductors such that each conductive spring rotatably and electrically contacts a different one of said annular conductors, said back face including a reduce diameter portion which extends through and rotatably engages the center aperture in said first housing portion;

a power cord having a plurality of electrical conductors, each electrical cord conductor being connected to a different one of said annular conductors, said power cord being rigidly fixed to said first plate and extending through said housing side wall for electrical connection to a remote device; and a plurality of electrically conductive prongs extending from the second face of said second support plate and through said center aperture for rotation with the second support plate, each electrically conductive prong being electrically connected to a different one of said conductive springs.

23. A low profile electrical plug as set forth in claim 22, wherein said means for connecting said first and second housing portions comprises a sonic weld formed between said first and second housing portions.

24. A low profile electrical plug as set forth in claim 22, wherein said first housing portion further includes a raised collet formed in said back face around said center aperture, the side wall from said second housing portion extending around said raised collet and engaging the back face of said first housing portion.

25. A low profile rotatable electrical plug as set forth in claim 24, further including a plurality of radial ribs formed in the back face of said first housing portion a plurality of reciprocal notches formed in said raised collet, said ribs being positioned to engage said notches to releasably lock the position of said second support relative to said housing.

* * * * *